United States Patent [19]

Schneider

[11] 3,932,198

[45] Jan. 13, 1976

[54] COATING SOLUTION HAVING TRIVALENT CHROMIUM AND MANGANESE FOR COATING METAL SURFACES

[75] Inventor: George Schneider, Trevose, Pa.

[73] Assignee: Amchem Products, Inc., Ambler, Pa.

[22] Filed: May 24, 1974

[21] Appl. No.: 473,097

[52] U.S. Cl. ..... 148/6.2; 427/409

[51] Int. Cl.[2] ..... C23F 7/26

[58] Field of Search ..... 148/6.2, 6.16

[56] References Cited

UNITED STATES PATENTS

| | | | |
|---|---|---|---|
| 2,678,291 | 5/1954 | Spruance, Jr. et al. | 148/6.16 |
| 3,222,226 | 12/1965 | Maurer et al. | 148/6.16 |
| 3,553,034 | 1/1971 | Harvey et al. | 148/6.2 |
| 3,647,569 | 3/1972 | Schneider | 148/6.16 |

*Primary Examiner*—Ralph S. Kendall
*Assistant Examiner*—Charles R. Wolfe, Jr.
*Attorney, Agent, or Firm*—Ernest G. Szoke; Howard S. Katzoff; Michael E. Zall

[57] ABSTRACT

A coating solution comprising trivalent chromium and one or more cations selected from the group consisting of manganese, bismuth, antimony tin, zinc and molybdenum is employed in a process wherein the solution is contacted with a metallic surface to form a corrosion resistant coating. The coating can be force dried or can be treated with a passivating solution.

15 Claims, No Drawings

COATING SOLUTION HAVING TRIVALENT CHROMIUM AND MANGANESE FOR COATING METAL SURFACES

BACKGROUND OF THE INVENTION:

There are known to be numerous coating compositions having hexavalent chromium for forming a corrosion resistant coating on metals. Such chromate coating compositions are useful in providing coatings which aid in the adhesion of subsequently applied siccative organic finishes. Should an organic finish be applied to such a chromate conversion coating, the organic finish can become discolored, particularly if it is of a light color. The discoloration is caused by a "bleeding" of soluble hexavalent chromium salts from the coating into the organic finish. Attempts have been made to reduce such discoloration in several ways. The most common method of eliminating the soluble hexavalent chromium salts from this coating is by rinsing. When a rinse is employed to remove the hexavalent chromium salts from the coating, a buildup of the soluble salts can occur in the rinse bath. To prevent the build-up of soluble chromate salts in a rinse bath, it is necessary to continually overflow the bath or discard the rinse solution once it is used.

Because of the problems associated with hexavalent chromium in the conversion coating, attempts have been made to modify the coated metallic surfaces. In some attempts to modify the coating, rinse compositions have been employed. Compositions having trivalent chromium have been used as a final rinse subsequent to contacting the metallic surface with a conversion coating composition. Such rinses have been found to aid the corrosion resistance and paint adhesion characteristics of previously coated metallic surfaces. For example, metal surfaces have been rinsed with a chromium final rinse composition, wherein a portion of the hexavalent chromium had been reduced to the trivalent state, by acids, aldehydes or alcohols.

Examples of such attempts are known in U.S. Pat. Nos. 3,063,877; 3,222,226; and 3,279,958.

Other attempts to solve the problems caused by the presence of hexavalent chromium in the conversion coating have been made by reducing the hexavalent chromium to the trivalent state in the coating itself after it is formed on the metal surface. Such procedures are found, for example, in U.S. Pat. Nos. 3,094,441 and 3,535,168 and British Pat. No. 1,114,645.

Such attempts resulted in decreasing the amount of soluble hexavalent chromium on the coated metal surface, but at the expense of contributing toxic compounds to the effluent of the process.

Effluents containing chromium have been found to be toxic, particularly when the chromium is in the hexavalent state. It is desirable to eliminate or diminish the amount of chromium and especially hexavalent chromium in the effluent. It has long been desirable to eliminate the rinse for reasons of the savings that could be realized in the cost product and apparatus. It is now desirable to prevent the discharge of harmful effluent of a conversion coating process for manifest reasons of environmental concern.

It is an object of this invention to produce a corrosion resistant coating on a metallic surface. It is another object of the invention to provide a coating solution and process which requires no subsequent rinsing. It is a concomitant object of the invention to provide process having a closed system for coating metal surface which eliminates effluent of the process. It is another object of the invention to provide a coating process which can be operated at room temperature. It is another object of the invention to form a conversion coating which is adherent of a subsequently applied siccative finish. Still other objects of the invention shall become evident from the description which follows.

DETAILED DESCRIPTION

Several discoveries underlie the present invention. The first of these is the discovery that an aqueous acidic coating solution comprising trivalent chromium and one or more cations selected from the group consisting essentially of manganese, bismuth, antimony, tin, zinc and molybdenum can be employed to form a corrosion resistant coating which permits the application of an organic siccative finish having excellent adhesion thereto. It has been found that the coating solution can be employed to contact a metal surface and form a corrosion resistant coating thereon. The coating formed is amorphous in structure that is to say there is no apparent crystalline structure when viewed under an optical microscope and it is generally blue to bluegrey in color.

The terms "metal" or "metallic" are used herein to describe iron or zinc. The terms "metal surface" or "metallic surface" refer to surfaces comprised of iron or zinc. By iron, we mean steel or other metals comprised predominantly of iron. By zinc, we mean not only metals comprised predominantly of zinc or its alloys, but also metals which are coated by zinc or its alloys, such as galvanized. It is of no consequence to the process of the invention whether the galvanized coating is applied by an electrolytic or by a hot-dipped process.

The term "coating solution" when used herein refers to the aqueous acidic solution of the invention comprising trivalent chromium and one or more cations selected from the group consisting essentially of manganese, bismuth, antimony, tin, zinc and molybdenum.

The terms "organic siccative coating" or "organic siccative finish" when used herein mean any organic covering which is applied to a metallic surface such as, paint, lacquer, enamel, and the like. Such organic finishes can be neutral or contain pigments for color.

The coating solution of the invention can be prepared in various ways. For example, cation constituents can be added to water in the form of their soluble salts. Any of their soluble salts, which do not interfere with the coating operation is satisfactory. For example, chlorides, nitrates and sulfates of the cation constituents can be employed. In order to be totally satisfactory, however, it is not enough that a solution can be made, or even sufficient, should the solutions form a coating on the metal surface. It is furthermore required that the anion of the salt be capable of being eliminated from the coating formed. When nitrates and sulfates occur in the coating, the metallic surface is found to be activated and susceptible to a reoccurrance of corrosion, such as for example a rust blush. It has been found that nitrates can be eliminated from the coated surface by heat and consequently rinsing is not required to remove the interfering anion.

It is known that metallic surfaces subsequent to coating are heated or subjected to an air blast to facilitate drying. It is desirable that the anion of the salt be one which is removed from the coated surface when the surface is heated.

In attempts to discover suitable salts of trivalent chromium and one or more of the cation constituents selected from the group of manganese, bismuth, antimony, tin, zinc and molybdenum, many organic salts were also tested; for example, acetate, formate, maleate, phthalate, gluconate, and glycolate salts. While solutions can be prepared with the above salts, they were found not to be satisfactory in all respects. The organic salts are more costly than mineral salts in general. Some organic salts decomposed or sublimed from the heated metallic surface produced unpleasant odors. Others caused undesirable chars to occur on the heated metallic surface.

It was discovered that the nitrate ion was preferred as it can be decomposed and eliminated by the drying procedures which are normally employed to dry a coated metallic surface prior to painting. Nitrates of the cation constituents are more easily obtained and less costly than others discussed above. It has therefore been found that the addition of a nitrate of the cation constituent to water will prepare a coating solution, which when contacted with a metallic surface will produce a corrosion resistant coating thereon.

In the process of the invention by which a conversion coating is formed on a metallic surface, the cation constituent preferred in addition to trivalent chromium is manganese, as the coatings formed are most adherent of the subsequently applied siccative finish as well as exhibiting excellent corrosion resistance under paint when exposed to a corrosive atmosphere. Of course, the concentration of the constituents in the coating solution are important to the performance of the process.

When the concentration of the cation constituents of manganese, bismuth, antimony, tin, zinc and molybdenum is discussed they are expressed in a stoichiometric equivalent of the amount of manganese which is expressed in grams per liter (g/l). In other words, cation concentrates will be expressed as those of the preferred manganese cation unless otherwise specified. When a concentration of 1 g/l of the cation is specified, it should be understood that should bismuth be employed in place of the preferred manganese, about 3.8 g/l of bismuth should be used; should antimony be employed in place of manganese, about 2.2 g/l of antimony should be used; should tin be employed in place of manganese, about 2.2 g/l of tin should be used; should zinc be employed in place of manganese, about 1.2 g/l of zinc should be used and should molybdenum be employed in place of manganese, about 1.7 g/l of molybdenum should be used.

It has been found that the trivalent chromium and an additional cation constituent selected from the group consisting essentially of manganese, bismuth, antimony, tin, zinc and molybdenum can be present in solution in amounts up to the limits of solubility. The maximum amounts, therefore, vary with the solubility of the specific salt employed to supply the cation constituent to the coating solution. It is preferred that the trivalent chromium be present in the amount of about 0.1 g/l to about 1.2 g/l in the coating solution. It is preferred that the additional cation constituent be present in the amount of about 0.2 g/l to about 1.0 g/l in the coating solution.

It has also been found that within the preferred concentration parameters of the chromium and the additional cation constituent disclosed above there are certain more preferred ranges, wherein a coating having improved performance characteristics under organic siccative finishes are obtained. It is therefore more preferred that trivalent chromium be present in the coating solution in the amount of about 0.8 g/l to about 1.2 g/l, and that the additional cation constituent be present in the coating solution in the amount of about 0.4 g/l to about 0.6 g/l. It has furthermore been determined that the chromium can be present in the coating solution in an amount from about 1 to about 6 parts by weight of trivalent chromium for each part by weight of the additional cation constituent on a weight basis. Preferably the weight ratio of chromium to the additional cation constituent present in the coating solution is about 1.5 to about 2.5 parts of chromium for each part of the additional cation constituent.

It is preferred to prepare a coating solution of the invention by supplying a dry or liquid concentrate, which can subsequently be dissolved in water. For example, a dry composition of trivalent chromium nitrate and manganese nitrate can be dissolved in water to produce a coating solution. It has been found that trivalent chromium nitrate and a carbonate or an oxide, for example, manganese carbonate, or bismuth oxide can be employed to produce an aqueous concentrate which can subsequently be added to sufficient water to make the coating solution of the invention. Of course, such a concentrate can require the addition of a suitable alkali or acid to adjust the pH of the coating solution within the working range described hereinbelow. It has been discovered that the carbonate anion causes no harm in the coating solution as it is quickly evolved from the solution as carbon dioxide gas. When, for example, manganese carbonate is employed as an aqueous concentrate, the solution is observed to effervesce with the dissolution of the dry salts in water. The evolution of carbon dioxide from the concentrate solution leaves only the nitrate anion in solution. Sufficient free nitrate is required to adjust the pH. The order in which the constituent salts are brought together to prepare an aqueous concentrate is not critical.

Should a dry composition be prepared to be added to water to make the coating solution, it's preferred that the cation constituents be added as their nitrate salts as they dissolve more quickly.

It is preferred, however, to prepare an aqueous acidic concentrate for preparing the coating solution as the coating solution is more quickly and easily prepared. Moreover constituent cations as their most easily obtained or least expensive salts, which are suitable, can be employed.

Formula I and Formula II below are examples of concentrates which can be subsequently added to water to prepare a coating solution of the invention.

FORMULA I

| | grams/liter |
|---|---|
| chromium nitrate | 450 |
| manganese carbonate | 100 |
| nitric acid | 54 |
| water to make 1 liter | |

FORMULA II

| | grams/liter |
|---|---|
| chromium nitrate | 225 |
| manganese nitrate | 157 |
| water to make 1 liter | |

When a coating solution is prepared by adding a concentrate to water, the pH of the solution can influence its operations. When, for example, about 10 ml of a concentrate of Formula I is added to water to make a liter of coating solution, a pH of about 4.0, is obtained. Coatings can be obtained when the pH of the coating solution is from about 2.5 to about 5.

It has been found that etching of the metallic surface can be excessive should the pH of the solution be below about 2.5. Should the pH of the coating solution be higher than about 5.0, the pH can be unstable and hard to control. It is preferred that the pH of the coating solution be from about 3.4 to about 4.5. It has been found that should the pH be above about 4.2 that the pH of the coating solution is lowered as the metal salts hydrolize, thereby generating acidity. When coating solutions having a pH greater than about 4.2 are rested, that is are freed of contact with the metallic surfaces being coated, the pH is lowered with time until it reaches stability at about a pH of 4.0 to 4.2. In the process by which a metallic surface is contacted with the coating solution the pH begins to rise and continues to rise until it becomes unstable. The reader is referred to further discussion on this aspect of the invention at a later point in the disclosure.

The pH of the coating solution can be adjusted by a simple addition of base or acid as required. Should it be desired to raise the pH of the coating solution, it can be raised by addition of any base as long as it does not interfere with the coating process. A preferred base is ammonium hydroxide. It has been found that ammonium hydroxide does not interfere with the coating process. The ammonium ion can be destroyed and eliminated from the coating during the drying operation. Should it be desired to lower the pH of the coating solution the addition of any acid will suffice which does not interfere with the coating process. An acid having the same anion used in the salts employed to prepare the coating solution is preferred. It is therefore preferred that nitric acid be employed to increase the acidity of the coating solution in the preferred embodiment of the invention.

During the process of forming a corrosion resistant coating on a metallic surface the coating solution can become depleted in certain of its constituents. For example, trivalent chromium and one or more of the additional cation constituents are deposited in the coating and are thereby removed from solution. Of course, it is understood by one familiar with the use of compositions for forming a coating that some metallic ion of the substrate surface will be found present in the coating solution. It should also be understood that the coating can have therein certain insoluble compounds of the substrate metal. When the constituents are depleted from the coating solution, replenishment is required.

Should replenishment become necessary, it can be effected by adding the trivalent chromium and one or more of the cations selected from the group consisting essentially of manganese, bismuth, antimony, tin, zinc and molybdenum to the coating solution in the form of any available salt thereof; preferably the salts which were originally used in the make-up of the coating solution.

To determine when replenishment is necessary, an analysis for the amount of trivalent chromium and the additional cation constituent can be made. Any method for determining the concentration of the cation can be employed. However, it has been determined that the chromium and additional cation are removed from the solution in approximately the same ratio as they occur in solution. Therefore, it is only necessary to add the constituents to the solution in the ratio they were originally employed to make the solution.

It is preferred to replenish with the concentrate originally employed to prepare the coating solution. It has been determined that a simple procedure for replenishment can be followed by monitoring the pH of the coating solution. During the process of forming a coating the pH begins to rise. Additions of, for example, a liquid concentrate of Formula I or Formula II until the pH is in the original range provides replenishment of the constituents removed from the coating solution in forming of the coating.

A coating solution used for long periods of time can be found to have a build-up of sludges in the tank, though sludge formation is slower than with many other coating compositions. For reclaiming the clear solution, any method known to the art can be employed. For example, the clear solution can be decanted from the sludge, or the bottom can be dumped as required. A settling of the sludge is aided, in any case, as the working solution does not require heat, which provides a stirring action.

In the process by which a coating solution of the invention is employed to produce a corrosion resistant coating on a metallic surface, the surface is first cleaned of soils which can interfere with the coating process. The metallic surface can be cleaned by any convenient method known to the art. A suitable cleaning process employes an alkaline cleaner. Should the metallic surface be severely soiled, a surfactant can be included in the alkaline cleaner. Furthermore, should the metallic surface be severely soiled it can be contacted by a surfactant and solvent prior to employing the alkaline cleaner to aid in the cleaning process.

Subsequent to the cleaner step, a water rinse is employed to prevent contamination of the coating solutions. A continuous overflowing water rinse, for example, is suitable to remove any residual cleaner from the surface. It is only necessary that the metallic surface be clean of all organic and inorganic residue for best coating results to be obtained. Subsequent to the cleaning and rinsing steps, the metallic surface is contacted with the coating solution.

Any method of contacting the metallic surface with the coating solution as is commonly employed in the metal coating art is acceptable. For example, the metal surfaces can be contacted by spraying, dipping, roller coating, or the like. When employing the coating solution of the invention, it is not necessary to heat the coatiang solution. An acceptable coating can be formed on a metallic surface at temperatures of between about 16°C and about 38°C. It has been found that although the coating solution can be employed at temperatures in excess of 38°C it is preferred that the coating operation be performed at about room temperature, that is, between about 21°C and about 32°C. A temperature in excess of about 38°C is to be avoided when possible as it can cause the pH of the solution to become unstable, and is difficult to maintain. Moreover, the cost of the operation is increased when heat is employed. Should the temperature of the coating solution be below about 16°C the speed of coating formation can be slowed beyond a reasonable coating period of about 30 seconds.

With respect to temperature, it has been discovered that heat can be employed to adjust the pH of the coating solution. For example, the pH of the coating solution can be lowered by heating the solution. As mentioned previously, it was determined that the pH of the coating solution rises as it is employed to contact a metallic surface. In summary it can be stated there are four ways in which the pH of the coating solution can be lowered. They are, by:

1. Replenishment of the coating solution.
2. The addition to the coating solution of a suitable acid, for example, nitric acid.
3. By allowing the coating solution to be rested.
4. By heating the coating solution, except over about 38°C.

It has likewise been disclosed hereinabove, that there are two ways of raising the pH. They are, by:

1. Adding a suitable alkali to the coating solution.
2. Employing the coating solution to contact a metallic surface.

It should be recognized that should the pH require lowering and the temperature of the coating solution be about 38°C, replenishment is indicated.

It is common practice in the metal coating art, to employ coating apparatus consisting of several stages. For example, a first stage can be employed for contacting the metal surface with a cleaning solution. A second stage can be employed for rinsing the metallic surface. Subsequent to rinsing, one to many stages, for example, 3 stages can be employed for coating. Subsequent to coating, there can be a water rinse stage, an acid final rinse stage, and a last water rinse stage. It is therefore not uncommon to find a process employing an apparatus consisting of from 5 to 7 stages.

In the process by which the coating solution of the invention is used, there can be employed an apparatus having a first stage for contacting the metallic surface with a cleaning solution; a second stage for water rinsing the cleaned metallic surface; and a third stage for contacting the metallic surface with the coating solution.

It has been found unnecessary to employ a final rinse. The coated metallic surface need only be dried. It is common in the metal treating art to force dry the metallic surface rapidly to facilitate handling and subsequent painting of the metallic articles. Any method by which the metallic surface is rapidly dried subsequent to contacting the metallic surface with the coating solution is suitable. For example, there can be employed a force air-blast or a heated drying oven.

Since only three stages are essential for the process of the invention a savings in time and space is realized.

Occasionally there may not be apparatus available for force drying the metallic surface. Should the metallic surface not be quickly dried, as for example by a forced air blast and/or heat, a rust-blush can be seen on the surface. This rust-blush has caused no lack of adhesion in the subsequent paint application, nor has it caused an increase in corrosion under paint when exposed to a corrosive atmosphere. For esthetic reasons it is desirable to eliminate the chance of acquiring a rust-blush on the coated surface. If, in particular, drying takes place in a humid atmosphere, the coated surface can be rinsed. However, to prevent even the relatively nontoxic effluent resulting from water rinsing the coated surface, there is provided a closed cycle rinse step in the process of the invention.

Subsequent to contacting the metallic surface with the coating solution, there is provided an aqueous passivating solution for rinsing the coated metallic surface.

It has been found that not all compounds known to the art as passivating agents or corrosion inhibitors are suitable. Some do not prevent rust-blush in the process of the invention. It has been found that a passivating agent selected from the group of alkali metal nitrates, amines, for example triethanolamine, and urea inhibit rust-blush. It is preferred to employ urea as it is inexpensive and is satisfactory overall when employed according to the method described herein below.

The amount of urea present in the rinse solution can be from about 1 g/l to about 300 g/l. Concentrations of urea below about 1.0 g/l. in the final rinse have been found to be inadequate for aiding corrosion resistance of the coated surface. Concentrations above about 300 g/l, produce a residue on the coated metallic surface which can be visible and can interfere with subsequent adhesion of organic finishes. It is a simple economic expedient to use the least amount of urea in the final rinse that is effective. For that reason it is preferred to use about 1 gram/liter of urea in the final rinse. When employing a urea rinse solution subsequent to coating, excess solution can be drained back into the rinse container and reused. In the re-cycling rinse process, some urea is carried out on the coated metallic surface, subsequently some replenishment of urea can from time to time become necessary.

Should the passivating rinse solution be employed, any method of drying prior to coating with the organic siccative finish is suitable. Should the surface be rinsed with the passivating solution it need not be force-dried to obtain superior corrosion resistance. The superior corrosion resistance over the prior art is also obtained in the aspect of the invention where in force-drying is employed subsequent to coating.

It is evident in the process, wherein the metallic surface is force-dried subsequent to coating and in the process wherein a closed cycle urea rinse is employed that no effluent results from the process. After repeated use the passivating rinse solution can become contaminated and require dumping, but the longevity of the rinse solution can aid considerably in reducing the cost of effluent treatment. Moreover, should urea be the passivating agent, some value as a plant food can be realized.

The following examples serve to further illustrate the process and coating solution of the invention.

EXAMPLE I

Several metallic nitrate salts are compared with the coating solution in this example. The metallic nitrates were dissolved in water to make the solutions and adjusted to pH 4.0 with 50% aqueous ammonium hydroxide. In this test there was employed solutions falling into three categories. The first set consisted of single metal nitrate salt solutions. The second set consisted of mixtures of trivalent chromium nitrate with no additional metal nitrate selected from the group comprising manganese, bismuth, tin, antimony, zinc and molybdenum. The additional metal nitrate was added in the stochiometric amount required to produce solutions of a molar equivalent of the amount of manganese employed in each set respectively. The third set comprised solutions the same as the second set, except they were artificially aged by dissolving therein, iron nitrate in the amount of 200 mg/l. The treatments having the dissolved iron salts are designated in Table I as "+Fe."

10 × 30 cm panels of unpolished plating stock of 1010 steel were cleaned in an alkaline cleaner and water rinsed. Subsequent to the cleaning and rinsing, the steel panels were contacted with the respective solutions of Table I by spraying at room temperature (22°C) for 60 seconds. Subsequent to contacting the treatment solutions, the panels were water-rinsed, except as noted and force-dried in a stream of compressed air. The dried panels were visually appraised for the amount and quality of coating as noted under the "coating remarks" heading of Table I. Subsequent to coating, the panels from coating treatments on which was formed acceptable coatings, were given two coats of asphatum based resin enamel paint. Each paint coat was cured at about 230°C for 45 minutes. The painted panels were then subjected to a salt spray corrosion test. The panels were scribed diagonally with a sharp steel scribe and exposed to a 5% sodium chloride salt spray mist for 168 and 336 hours in accordance with ASTM-B 117 specification.

During the salt spray test, the panels were in a position 15° from vertical, and at a temperature of about 35°C.

Subsequent to the salt spray test, the panels were evaluated by:

a. counting the number of corrosion pits per panel, and b. measuring the maximum distance paint could be scrubbed from the surface perpendicular to the scribed line. This evaluation is noted as "scribe failure" and the units of measure are given in millimeters (mm).

The results of the test are compiled in Table I below.

TABLE I-a

| | Treatment | | | | g/l | Coating Remarks | Corrosion Remarks |
|---|---|---|---|---|---|---|---|
| A | $Cr(NO_3)_3$ | | | | 4.5 | no coating | rust |
| B | $Mn(NO_3)_2$ | | | | 3.4 | no coating | rust |
| C | $Sn(NO_3)_2$ | | | | 4.7 | no coating | rust |
| D | $Sb(NO_3)_3$ | | | | 5.9 | very pale grey stain | light rust |
| E | $Mo(NO_3)_2$ | | | | 4.2 | blue coating | no rust |
| F | $Cr(NO_3)_3$ | + | $Mn(NO_3)_2$ | | 4.5,1.7 | blue | light rust on drying |
| G | $Cr(NO_3)_3$ | + | $Sn(NO_3)_2$ | | 4.5,2.3 | no coating | rust |
| H | $Cr(NO_3)_3$ | + | $Sb(NO_3)_2$ | | 4.5,2.3 | no coating | rust |
| I | $Cr(NO_3)_3$ | + | $Mo(NO_3)_2$ | | 4.5,2.1 | very pale grey stain | light rust |
| J | $Cr(NO_3)_3$ | + | $Bi(NO_3)_3$ | | 4.5,3.8 | thin golden brown | light rust |
| K | $Cr(NO_3)_3$ | + | $Zn(NO_3)_2$ | | 4.5,1.8 | very pale blue | light rust |
| L | $Cr(NO_3)_3$ | + | — | +Fe | 4.5,0.2 | very pale blue | light rust |
| M | $Cr(NO_3)_3$ | + | $Mn(NO_3)_2$ | +Fe | 4.5,1.7,0.2 | blue | very little rust on drying |
| N | $Cr(NO_3)_3$ | + | $Sn(NO_3)_2$ | +Fe | 4.5,2.3,0.2 | pale blue | rust |
| O | $Cr(NO_3)_3$ | + | $Sb(NO_3)_2$ | +Fe | 4.5,2.3,0.2 | no coating | rust |
| P | $Cr(NO_3)_2$ | + | $Mo(NO_3)_2$ | +Fe | 4.5,2.1,0.2 | no coating | rust |
| Q | $Cr(NO_3)_3$ | + | $Bi(NO_3)_3$ | +Fe | 4.5,3.8,0.2 | pale blue | light rust |
| R | $Cr(NO_3)_3$ | + | $Zn(NO_3)_2$ | +Fe | 4.5,1.8,0.2 | pale blue, more uniform than Q | light rust |

TABLE I-b

| | Salt Spray Results | | | |
|---|---|---|---|---|
| | Treatment (cross referenced from Table I-a) | | 168 hour exposure | 336 hour exposure |
| | J | $Cr(NO_3)_3$ + $Bi(NO_3)_3$ | 2.3 mm | 12.5 mm |
| | K | $Cr(NO_3)_3$ + $Zn(NO_3)_2$ | 1.6 mm | 3.1 mm |
| | L | $Cr(NO_3)_3$ + Fe | almost complete loss of paint | |
| | M | $Cr(NO_3)_3$ + $Mn(NO_3)_2$ +Fe | 4.7 mm | 6.3 – 12.5 mm |
| * | $M_1$ | $Cr(NO_3)_3$ + $Mn(NO_3)_2$ +Fe | trace | trace |
| ** | $M_2$ | $Cr(NO_3)_3$ + $Mn(NO_3)_2$ +Fe | trace | trace – .78 mm |
| | N | $Cr(NO_3)_3$ + $Sn(NO_3)_2$ +Fe | 9.4 – 3.1 mm | 9.4 – 12.5 mm |
| | Q | $Cr(NO_3)_3$ + $Bi(NO_3)_3$ +Fe | 2.3 mm | 12.5 mm |
| | R | $Cr(NO_3)_3$ + $Zn(NO_3)_2$ +Fe | 1.6 mm | 3.1 mm |

* no rinse, air dry
** no rinse, baked dry

EXAMPLE II

Coating solutions of the invention were herein compared with two conversion coating compositions known to the art. 10 × 30 cm panels of unpolished cold-rolled plating stock of 1010 steel were cleaned with a non-alkaline cleaner and water-rinsed. The panels were then contacted with an accelerated phosphate coating composition obtained by adding to water 8.6 grams/liter of Formula III below and adjusted to pH 5.5 with 25% sodium hydroxide solution.

FORMULA III

| | grams |
|---|---|
| $H_3PO_4$ | 2000 |
| $Na_2O$ | 608 |
| $NaClO_3$ | 736 |
| water | to make one liter |

The resulting composition was employed for Treatment A of Table II herein below.

The composition was brought in contact with the panels by spraying for 60 seconds at 70°C. Subsequent to the coating step, the panels were sprayed with a final-rinse having 0.26 g/l of total chromium in which 40% of the hexavalent chromium was present in the reduced trivalent state. The reduced chromium final-rinse was employed to improve the performance of the coating under a siccative organic covering in a manner commonly employed in the art.

A second prior art composition was provided having zinc, phosphate, and nickel. 254 ml of the concentrate of Formula IV was added to 135 liters of water to make the zinc phosphate coating composition for treatment B of Table II.

FORMULA IV

| | |
|---|---|
| ZnO | 202 g/l |
| $H_3PO_4$ | 705 g/l |
| NiO | 13 g/l |
| $FeCl_3$ | 3 g/l |
| $NaClO_3$ | 60 g/l |
| water to make 1 liter | |

The pH was adjusted to approximately 3.2 with 25% sodium hydroxide as measured electrometrically.

10 × 30 cm panels of unpolished cold-rolled plating stock of 1010 steel was cleaned with an activating alkaline cleaner and then water rinsed. The cleaned panels were then contacted with the zinc phosphate coating composition by spraying for 60 seconds at 50°C. Subsequent to coating, the panels were sprayed with a final-rinse having 0.26 g/l of total chromium in which 40% of the hexavalent chromium was present in the reduced trivalent state.

A third test solution having a pH of 3.4 was prepared by adding 10 ml of Formula I to 990 ml of water. The resulting coating solution was employed in treatment C of Table II.

The coating solution of treatment C was brought into contact with 10 × 30 cm panels of the unpolished plating stock 1010 steel by spraying in the same way as was the prior art compositions above. The panels were sprayed, however, for 20 seconds at 40°C.

A fourth test solution having a pH of 4.4 was prepared by adding 10 ml of Formula I to 990 ml of water. The pH was adjusted by adding 25% ammonium hydroxide to the coating solution. The pH was monitored electrometrically during the adjustment. This coating solution was used for treatment D in Table II.

10 × 30 cm panels of unpolished cold-rolled plating stock of 1010 steel were cleaned with an alkaline cleaner. Subsequent to cleaning, the panels were water rinsed. The cleaned panels were then contacted with the coating solution for treatment D by spraying. The panels were sprayed for 15 seconds at 31°C.

No final rinse was employed on the panels treated by the coating solutions of treatments C and D.

Subsequent to the treatments described above, all panels of the four treatments were force-dried by compressed air.

A panel selected at random from each treatment set was weighed, stripped in a 5% chromic acid solution, and again weighed to determine the coating weight of the conversion coating produced by the respective treatments. The coating weights are compiled in Table II-a below.

The remaining panels of each treatment set were painted with two coats of an asphaltum based resin enamel paint. Each of the two coats were cured at about 230°C for 45 minutes. The panels were scribed diagonally with a sharp steel scribe and subjected to a 50% salt spray corrosion test as described in Example I above.

Randomly selected, painted and scribed panels from each treatment set were subjected to a standard humidity test by suspending the panels at an angle of 15° from the horizontal above a pan of water at 60°C for 500 hours.

All panels, when removed from the humidity chamber, were without failure.

The average number of corrosion pits per panel and the maximum distance of paint peeling (Scribe failure) after 168 hours of salt spray exposure is shown in Table II-b. The average number of corrosion pits per panel and the maximum distance of paint peeling (Scribe failure) after 336 hours of salt spray exposure is recorded in Table II-c.

TABLE II-a

| | TREATMENT | UNPAINTED PANELS COATING WT. mg/square foot |
|---|---|---|
| A | accelerated phosphate coating composition at 70° for 60 sec. + final rinse | 40 |
| B | zinc phosphate coating composition at 50°C for 60 sec. + final rinse | 165 |
| C | coating solution using Formula I at 40°C for 20 sec. | 40 |
| D | coating solution using Formula I at 31°C for 15 sec. | 34 |

TABLE II-b

| TREATMENT | PAINTED PANELS 168 HOUR SALT SPRAY AVERAGE NUMBER OF PITS/PANEL | SCRIBE FAILURE (mm) |
|---|---|---|
| A | 8 | .8, .8 |
| B | 9.5 | trace, trace |
| C | 8 | 1.6, .8, .4 |
| D | 7 | trace, 1.2, 1.2 |

TABLE II-c

| TREATMENT | PAINTED PANELS 336 HOUR SALT SPRAY AVERAGE NUMBER OF PITS/PANEL | SCRIBE FAILURE (mm) |
|---|---|---|
| A | 7 | 1.6, 1.6 |
| B | 9 | .4, .4 |
| C | 7 | 1.6, 1.6, .8 |
| D | 9 | trace, trace, trace |

EXAMPLE III

10 × 30 cm panels of (1) unpolished cold-rolled plating stock of 1010 steel, (2) commercial stamping stock of 1010 grade steel, and (3) hot dipped minimized spangle galvanized steel were employed in this example. The panels were cleaned in an alkaline cleaner and contacted with the following coating solution by spraying for 15 seconds at 38°C.

The coating solution was obtained by adding 1.35 liters of Formula I to 133.65 liters of water. The coating solution was found to have a pH of 3.9. Cleaning, rinsing, and coating steps were carried out in an automatic pilot plant line. The pilot plant line comprises a long cabinet having multiple spray stages in a fashion similar to a factory spray line. The panels are contacted by spraying in the respective stages with the alkaline cleaner, a water rinse and the coating solution. Subsequent to the coating step, random panels of each type were stripped for a coating weight determination according to the procedure described in Example II above. The remaining coated panels were painted with two coats of an asphaltum based resin enamel. The enamel was cured at 230°C for 45 minutes following the application of each coat. Randomly selected painted panels of each of the metal classes were subjected to a humidity test in the same way as described in Example II above.

The remaining panels were subjected to a salt spray test according to the method described in Example II above. Likewise, in a manner therein described, evaluations were made on some panels after 168 hours and the remaining panels after 336 hours of salt spray exposure. The results of the tests are compiled in Table III below.

TABLE III

| Panel Type | Unpainted coating wt. mg./sq.ft. | PAINTED PANELS 168 HOURS SALT SPRAY Ave. No. of Pits | Scribe Failure (mm) | 336 HOURS SALT SPRAY Ave. No. of pits | Scribe Failure (mm) |
|---|---|---|---|---|---|
| Unpolished plating stock | 34 | 7 | trace, 2.4, 2.4 | 9 | trace, trace, trace |
| Commercial stamping stock (good blue coating) prior to painting | 35 | 9.5 | trace, trace 0.8 | 6.5 | 1.6, 2.4, 0.8 |
| Galv. steel of minimized spangle (faint, bluish, coating) prior to painting | 13.5 | 7 | 1.6,2.4,2.4 | 6 | 2.0,3.2,3.2 |

These results indicate a minimum loss of paint at the scribe mark, whereby excellent corrosion resistance is exhibited by the coating solution.

EXAMPLE IV

Panels of unpolished cold-rolled plating stock of 1010 steel in this example were baked dry subsequent to contacting the panels with a coating solution and prior to receiving one coat of asphaltum based resin enamel.

The 10 × 30 cm steel panels were cleaned with an alkaline cleaner and water rinsed. A coating solution was prepared by adding 1.35 liters of Formula I to 133.65 liters of water. The coating solution was adjusted to a pH of 4.15 by the addition of 25% ammonium hydroxide. The pH was monitored electrometrically during pH adjustment.

The panels subsequent to cleaning and rinsing were divided into four equal sets. One set of panels was contacted for 10 seconds with the coating solution adjusted to a pH of 3.2 with nitric acid and run at a temperature of 60°C. The remaining panels were contacted with the coating solution described above by spraying for 15, 30, and 60 seconds respectively at a temperature of 24°C. All treatments were run in the pilot plant spray coating line employed in Example III above.

Subsequent to the coating step, the panels were baked dry in an oven at 150°C for 10 minutes. The dried panels were spray painted with one coat of an asphaltum based resin enamel. The painted panels were cured at 230°C for 45 minutes.

The painted and cured panels were scribed and subjected to a 5% salt spray according to the methods described in Example III. The panels were evaluated according to the procedure described in Example III above.

The results of the evaluation are compiled in Table IV below.

TABLE IV

| TREATMENT PERIOD | Ave. No. of Pits | 168 hour scribe failure (mm) |
|---|---|---|
| 10 second spray (3.2 pH,60°C) | 9.0 | trace, trace, trace |
| 15 second spray | 9.5 | 0.4, trace, trace |
| 30 second spray | 9.5 | 0.4, trace, trace |
| 60 second spray | 9.5 | 0.4, 0.4, trace |

EXAMPLE V

In this example, panels of unpolished cold-rolled plating stock of 1010 steel and panels of commercial stamping stock of 1010 steel were rinsed with recirculated tap water, or alternatively with a recirculated 0.1% urea solution following contact with a coating solution of the invention.

The 10 × 30 cm steel panels were cleaned with an alkaline cleaner and water rinsed. A coating solution was prepared by the addition of 1.35 liters of Formula I to 133.65 liters of water. The coating solution was found to have a pH of 4.0.

The cleaned steel panels were brought in contact with the coating solution for 90 seconds at a temperature of 27°C in the pilot plant spray line employed in Example III above. The coated panels were randomly divided into two sets for each steel class. One set of coated panels from each steel class was rinsed by spraying for 5 seconds at 22°C with recirculated tap water. The other set of coated panels from each class was rinsed by spraying for 5 seconds at 22°C with a recirculated 1 g/l urea solution.

Each of the sets of coated and rinsed panels were dried at room temperature for 0.5 hour. Several panels of each set were subjected to a humidity test as described in Example III. A rust-blush appeared after 48 hours exposure in the humidity test chamber on the tap water rinsed set of commercial stamping stock steel panels. The tap water-rinsed set of plating stock steel panels was free of any rust-blush. All panels rinsed in the 1 g/l urea solution were free of any rusty appearance after 48 hours of high humidity exposure.

The remaining panels consisting of the two steel stocks, each divided into the two rinsing treatments subsequent to coating were subdivided to receive paint according to two well known systems. Of the latter subdivision, one group received a 3-coat paint system consisting of a primer epoxy coat having a red oxide pigment, a second epoxy coat having a grey oxide pigment and a top coat of thermal setting acrylic enamel. The first two coats were each heat cured at about 175°C for 20 minutes and the top coat was cured at about 120°C for 30 minutes. The remaining subdivided group was painted in a 2-coat asphaltum based resin enamel system. Each of the 2 coats were cured at about 230°C for 45 minutes.

The painted panels were scribed and subjected to a 5% salt spray test as described in Example I above.

The panels painted in the 3-coat system were evaluated for corrosion and scribe failure after 240 hours of salt spray exposure. The panels painted with the 2-coat system were evaluated after 336 hours of salt spray exposure.

The results of the tests are compiled in Table V-a and V-b below.

TABLE V-a

Scribe failure in millimeters of peeled paint on coated panels covered in the 3-coat paint system after 240 hours of salt spray exposure.

| Panel Type | Tap water rinsed | Rinsed by 0.1% urea solution |
|---|---|---|
| Unpolished plating stock panels (4 panels) | 0, 0, 0, trace | 0, 0, 0, 0 |
| Commercial stamping stock steel panels (4 panels) | 0, 0, 0, 0 | 0, 0, 0, 0 |

TABLE V-b

Scribe failure in millimeters of peeled paint on coated panels covered in the 2-coat paint system after 336 hours of salt spray exposure.

| Panel Type | Tap water rinsed | | | | Rinsed by 0.1% urea solution | | | |
|---|---|---|---|---|---|---|---|---|
| Unpolished plating stock panels (4 panels) | 3.2, G-, | 2,4, G-, | 3.2, G-, | 2.4 *G- | 1.6, G, | 1.6, G, | 1.6, G, | 1.6 G |
| Commercial stamping stock steel panels (4 panels) | 3.2, G-, | 3.2, G-, | 2.4, G-, | 2.4 G- | 1.6, G, | 1.6, G, | 1.6, G, | 1.6 G |

* Ratings by letter provide a subjective rating of the general visual appearance of the panel wherein ratings of good (G), fair (F), and poor (P) were considered.

There was little difference between tap water rinsed panels and the 1 g/l urea rinsed panels having the 3-coat paint system after 240 hours in the 5% salt spray. In the 336 hour exposure, after painting with the 2-coat paint system, the tap water rinsed panels were inferior to the 1 g/l urea rinsed panels; showing about twice the scribe failure of the urea rinsed panels.

I claim:

1. An aqueous acidic coating solution for forming a conversion coating on a metallic surface, consisting essentially of trivalent chromium and one or more cations selected from the group consisting of manganese, bismuth, antimony, tin, zinc and molybdenum, the trivalent chromium present in an amount of from about 0.1 g/l to about 2 g/l and the cation present in a stoichiometric equivalent amount of from about 0.2 g/l to about 1.0 g/l of manganese.

2. The coating solution of claim 1, wherein the trivalent chromium and the cation are present as water soluble salts.

3. The coating solution of claim 2, wherein the trivalent chromium is present as chromium nitrate and the cation is present as a water soluble salt having an anion selected from the group consisting of nitrate, carbonate, or oxide.

4. The coating solution of claim 1, wherein the trivalent chromium is present in an amount from about 1 to about 6 parts by weight for each part by weight of the cation.

5. The coating solution of claim 1, wherein the trivalent chromium is present in the amount of from about 0.8 g/l to about 1.2 g/l.

6. The coating solution of claim 1, wherein the cation is present in an amount stoichiometrically equivalent to from about 0.4 g/l to about 0.6 g/l of manganese.

7. The coating solution of claim 1, wherein the trivalent chromium is present in the amount by weight of from about 1.5 parts to about 2.5 parts for each part of the cation.

8. The coating solution of claim 1, wherein the cation present is manganese.

9. An aqueous acidic concentrate consisting essentially of trivalent chromium present as chromium nitrate and manganese present as manganese carbonate.

10. A process comprising contacting a metallic surface with a coating solution consisting essentially of trivalent chromium and one or more cations selected from the group consisting of manganese, bismuth, antimony, tin, zinc and molybdenum, the trivalent chromium present in an amount of from about 0.1 g/l to about 2 g/l and the cation present in a stoichiometric equivalent amount of from about 0.2 g/l to about 1.0 g/l of manganese.

11. The process of claim 10, wherein the surface is thereafter dried.

12. The process of claim 10, wherein the surface is thereafter contacted with an aqueous passivating rinse solution and then dried, the rinse solution comprising a passivating agent selected from the group consisting of an amine, urea, and alkali metal nitrates.

13. The process of claim 12, wherein the rinse solution is a urea solution.

14. The process of claim 13, wherein the urea is present in the rinse solution from about 1 g/l to about 300 g/l.

15. The process of claim 10, wherein an organic siccative finish is thereafter applied to the surface.

* * * * *